US011079196B2

(12) United States Patent
Kim

(10) Patent No.: US 11,079,196 B2
(45) Date of Patent: Aug. 3, 2021

(54) TOY GUN

(71) Applicant: Gwangsuk Kim, Gimhae-si (KR)

(72) Inventor: Gwangsuk Kim, Gimhae-si (KR)

( * ) Notice: Subject to any disclaimer, the term of this patent is extended or adjusted under 35 U.S.C. 154(b) by 317 days.

(21) Appl. No.: 16/082,264

(22) PCT Filed: Apr. 5, 2016

(86) PCT No.: PCT/KR2016/003528
§ 371 (c)(1),
(2) Date: Sep. 4, 2018

(87) PCT Pub. No.: WO2017/150765
PCT Pub. Date: Sep. 8, 2017

(65) Prior Publication Data

US 2019/0093977 A1 Mar. 28, 2019

(30) Foreign Application Priority Data

Mar. 4, 2016 (KR) ..... 10-2016-0026336

(51) Int. Cl.
*F41A 33/06* (2006.01)
*A63H 29/22* (2006.01)
(Continued)

(52) U.S. Cl.
CPC ..... *F41A 33/06* (2013.01); *A63H 5/04* (2013.01); *A63H 29/22* (2013.01); *A63H 31/08* (2013.01); *F41B 11/89* (2013.01)

(58) Field of Classification Search
CPC . F41A 33/00; F41A 33/06; A63H 5/04; F41B 11/89; F41G 3/26
See application file for complete search history.

(56) References Cited

U.S. PATENT DOCUMENTS 4,109,608 A * 8/1978 Horikawa ..... A63H 5/04 116/137 R
6,564,788 B1 * 5/2003 Hu ..... F41B 7/003 124/66

(Continued)

FOREIGN PATENT DOCUMENTS

CN 101832734 A 9/2010
JP 2011-185514 A 9/2011

(Continued)

*Primary Examiner* — Kurt Fernstrom
(74) *Attorney, Agent, or Firm* — Maschoff Brennan

(57) ABSTRACT

The present invention relates to a toy gun having a bolt configured to move forward or backward such that a recoil and a following thrill can be experienced as in the case of an actual gun. The toy gun according to the present invention comprises: a body for firing dummy bullets; a bolt assembly provided inside the body so as to move forward or backward in the process of loading and firing the dummy bullets; and a driving portion provided inside the body so as to drive the bolt assembly in order to load and fire the dummy bullets, wherein the driving portion comprises a ratchet gear configured to receive power from a driving motor that drives the driving portion, a piston gear that receives power from the ratchet gear and moves the bolt assembly backward, and a ratchet assembly that selectively transfer power, which is transferred to the ratchet gear, to the piston gear; the ratchet assembly comprises a piston gear cap that penetrates the ratchet gear and is coupled to the piston gear while the ratchet gear remains fitted to the center of the piston gear cap and a ratchet pole configured to slide in a direction with regard to the piston gear cap; and an engaging groove, into which the ratchet pole is inserted, is provided on the inner surface of the piston gear such that, as the ratchet pole is inserted into and released from the engaging groove, power is selectively transferred from the driving motor to the piston gear.

5 Claims, 12 Drawing Sheets

(51) Int. Cl.

| | |
|---|---|
| ***F41B 11/89*** | (2013.01) |
| ***A63H 5/04*** | (2006.01) |
| ***A63H 31/08*** | (2006.01) |

(56) References Cited

U.S. PATENT DOCUMENTS

| | | | | |
|---|---|---|---|---|
| 7,694,448 | B2 * | 4/2010 | Iwasawa | F41B 11/644 42/54 |
| 8,074,392 | B2 * | 12/2011 | Hu | F41B 11/89 42/54 |
| 8,449,346 | B2 * | 5/2013 | Lee | F41B 11/644 446/405 |
| 8,608,474 | B2 * | 12/2013 | Markert | F41A 33/06 434/18 |
| 8,800,541 | B2 * | 8/2014 | Hu | F41A 33/06 124/66 |
| 9,791,236 | B2 * | 10/2017 | Lee | F41B 11/642 |
| 2009/0007896 | A1 * | 1/2009 | Chung-Kuan | F41B 11/89 124/69 |
| 2011/0214654 | A1 * | 9/2011 | Lee | F16H 1/04 124/31 |
| 2017/0176132 | A1 * | 6/2017 | Kang | F41B 11/89 |

FOREIGN PATENT DOCUMENTS

| | | | |
|---|---|---|---|
| KR | 20-1993-0007264 | Y1 | 10/1993 |
| KR | 10-2010-0136609 | A | 12/2010 |
| KR | 10-1231424 | B1 | 2/2013 |
| KR | 10-2014-0142460 | A | 12/2014 |
| KR | 10-1548253 | B1 | 8/2015 |
| WO | 2014148652 | A1 | 9/2014 |

* cited by examiner

TOY GUN

TECHNICAL FIELD

The present invention relates to a toy gun and more specifically, to a toy gun having a bolt configured to move forward or backward such that recoil and a following thrill can be experienced as in the case of an actual gun.

DESCRIPTION OF THE RELATED ART

In the case of a toy gun, a thrill is hardly felt because the recoil of a toy gun is not the same as that of an actual gun. Accordingly, a toy gun with a built-in piston has been used such that recoil can be experienced as in the case of an actual gun. However, a conventional toy gun simply has a piston and has no component acting as a bolt that causes recoil in the case of an actual gun. In addition, a conventional toy gun with a bolt also has a problem. The problem is that gears are damaged in a continuous shot state because gears, driving a bolt, do not smoothly connect with each other.

DETAILED DESCRIPTION OF THE INVENTION

Technical Problems

As a means to solve the problems, the present invention is directed to a toy gun provided with a bolt assembly that moves forward or backward in the process of loading and firing dummy bullets such that recoil can be experienced as in the case of an actual gun.

Further, the present invention is directed to a toy gun provided with a gear that is selectively coupled or separated such that gears can operate without bumping into each other in a continuous shot state.

Problems solved by the present invention are not limited to the above-described ones, and other problems that will be solved by the present invention while not described herein will become apparent to one of ordinary skill in the art to which the present invention pertains from the following description.

Technical Solutions

A toy gun according to the present invention includes: a body for firing dummy bullets; a bolt assembly provided inside the body so as to move forward or backward in the process of loading and firing the dummy bullets; and a driving portion provided inside the body so as to drive the bolt assembly in order to load and fire the dummy bullets, wherein the driving portion includes: a ratchet gear configured to receive power from a driving motor; a piston gear that receives power from the ratchet gear and moves the bolt assembly backward; and a ratchet assembly configured to selectively transfer, to the piston gear, power transferred to the ratchet gear, wherein the ratchet assembly includes: a piston gear cap that penetrates the ratchet gear and is coupled to the piston gear in the state where the ratchet gear is fitted into the center of the piston gear cap; and a ratchet pole configured to slide in one direction with regard to the piston gear cap, wherein an engaging groove, into which the ratchet pole is inserted, is provided on the inner circumferential surface of the piston gear such that power of the driving motor is selectively transferred to the piston gear as the ratchet pole is inserted into and released from the engaging groove.

Further, a toy gun according to the present invention includes a piston provided inside the bolt assembly and configured to push and fire the dummy bullets; a piston spring provided inside the piston and supplying elastic power to the piston; and a spring support part inserted into the piston spring and guiding the piston spring, wherein the piston spring is compressed while wrapping the spring support part and stretched in a direction where the piston spring moves away from the spring support part.

Further, a toy gun according to the present invention includes a trigger configured to swivel, installed at the driving portion and configured to fire the dummy bullets according to a user's manipulation; a driving power switch installed at the driving portion and configured to supply power to the driving portion and to block power of the driving portion; a power-on part linked with the ratchet gear and configured to supply power to the driving power switch; a power-off part linked with the ratchet gear and configured to block power of the driving power switch; and a gear rotation prevention device installed on one side of the trigger and caught by and released from a protrusion of the piston gear, wherein the gear rotation prevention device swivels the power-on part such that the driving power switch is turned on when the trigger is pulled and then the piston moves forward, the bolt assembly is moved backward by the piston gear when the driving power switch is turned on and then the ratchet gear rotates, and the ratchet pole pushes and lifts the power-off part such that the driving power switch is turned off when the ratchet gear moves the bolt assembly backward.

Further, a toy gun according to the present invention includes a gear disengagement device provided on one side of the ratchet gear and configured to release the ratchet pole from the engaging groove, wherein the ratchet pole is pressed by the gear disengagement device and released from the engaging groove such that the ratchet gear and the piston gear are separated when the bolt assembly moves backward and then the driving power switch is turned off, the driving motor partially rotates and is linked by means of inertial force such that the ratchet gear is driven even though the driving power switch is turned off, and the piston gear is caught and fixed by the gear rotation prevention device in the state where the piston gear and the ratchet gear are separated such that the piston gear is prevented from bumping into the bolt when the bolt moves forward again.

Further, a toy gun according to the present invention includes an adjustment lever installed on one side of the driving portion, connected with the driving portion, and configured to set a state where the dummy bullets are fired according to the user's manipulation, wherein the upper portion of the trigger and the power-on part are caught such that the driving power switch is kept on when the trigger is pulled if the adjustment lever is in a continuous shot state.

Advantageous Effects

Provided is a toy gun according to an embodiment of the present invention provided with a bolt assembly that moves forward or backward in the process of loading and firing dummy bullets such that recoil can be experienced as in the case of an actual gun.

Further, provided is a toy gun provided with a gear that is selectively coupled or separated such that gears can operate without bumping into each other in a continuous shot state.

Further, an area circumscribed by a ratchet pole inserted into a groove of a piston gear cap is large. Accordingly, a large amount of power can be transferred to a piston gear, and a bolt assembly moved backward by a piston gear can have a heavy weight such that a toy gun has a weight almost the same as that of an actual gun.

Further, a series of processes such as a process of pulling a trigger so as to fire a dummy bullet, a process of re-loading a dummy bullet are performed in a proper cycle such that operations can be smoothly performed.

Figure 1:
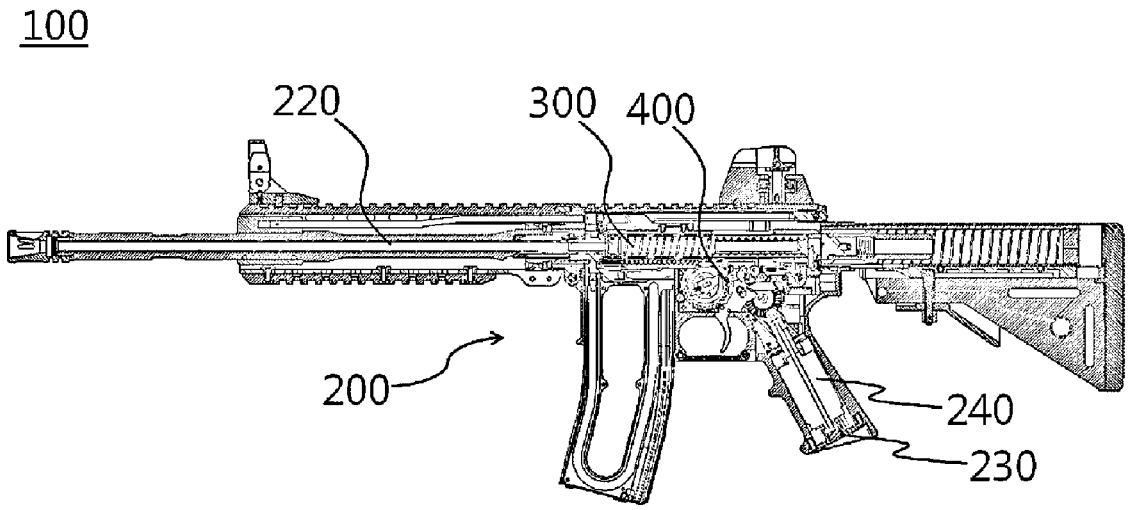
FIG. 1 is a sectional view illustrating the entire appearance of a toy gun according to the present invention.
Figure 2:
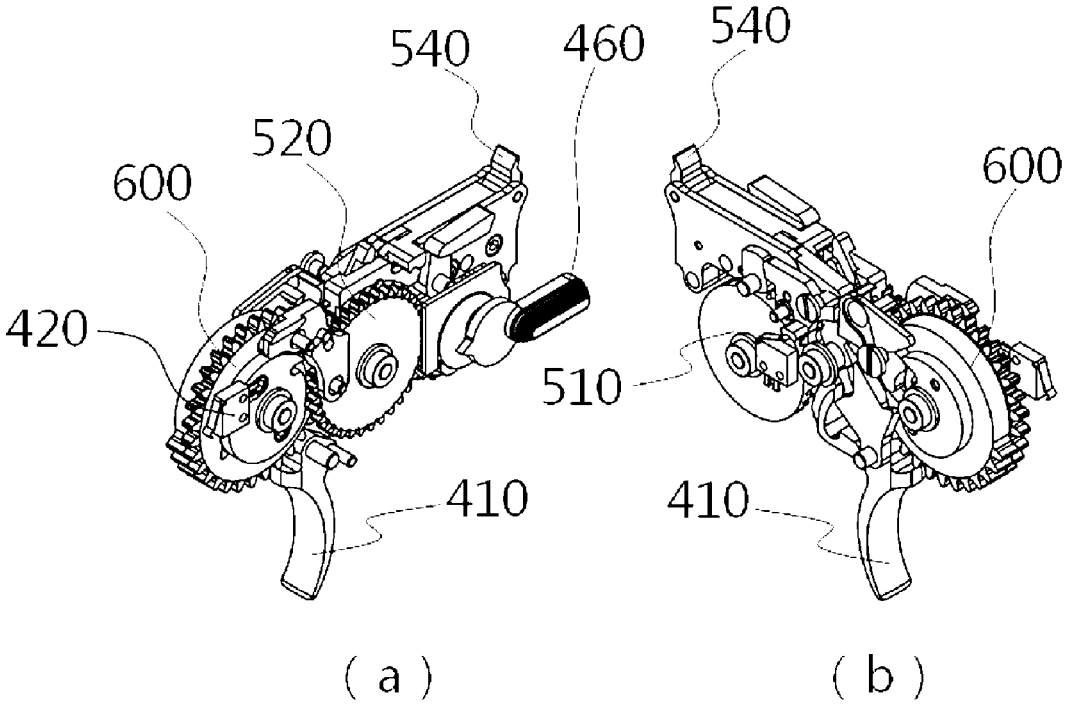
FIG. 2 is a view illustrating a driving portion of a toy gun according to the present invention.
Figure 3:
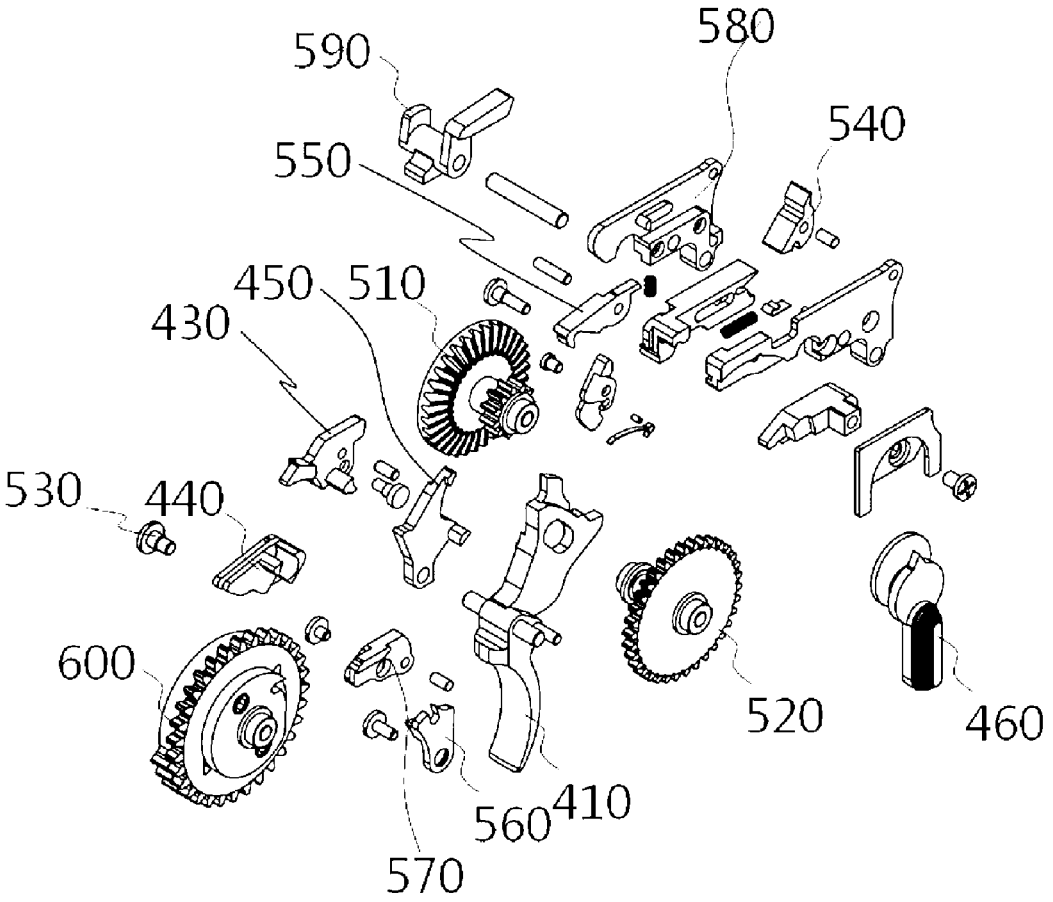
FIG. 3 is an exploded view illustrating parts of a driving portion of a toy gun according to the present invention.

100: Toy gun
200: Body
210: Cartridge chamber
220: Gun barrel
230: Handle
240: Driving motor
300: Bolt assembly
310: Bolt spur gear
320: Piston
330: Piston spring
340: Spring support part
350: Bolt
360: Charging handle
400: Driving portion
410: Trigger
420: Driving power switch
430: Power-on part
440: Power-off part
450: Gear rotation prevention device
460: Adjustment lever
500: Gear part
510: First gear
520: Second gear
530: Gear disengagement device
540: Shear
550: Shear hook
560: Gear coupling device
570: Gear coupling operation device
580: Shear operation device
590: Continuous shot shear operation device
600: Third gear
610: Piston gear
620: Ratchet gear
630: Piston gear cap
640: Ratchet pole
650: Ratchet pole spring
660: Engaging groove
670: Ratchet assembly Mode for Carrying Out the Invention Details including problems to be solved, solutions of the present invention, and advantageous effects of the present invention are included in the embodiments and drawings that will be described hereunder. The advantageous effects and features of the present invention, and methods for obtaining them will become apparent with reference to the embodiments and the attached drawings that will be described in detail.

The present invention will be described in detail with reference to the attached drawings.

A toy gun 100 according to the present invention, as illustrated in FIGS. 1 to 23, includes a body 200, a bolt assembly 300, and a driving portion 400.

First, a body 200 is provided.

Specifically, the body 200 includes a cartridge chamber 210 onto which dummy bullets provided from a magazine are mounted, a gun barrel 220 connected with the cartridge chamber, and a handle 230 gripped by a user.

Next, the body 200 has a bolt assembly 300 therein.

Specifically, the bolt assembly 300 moves forward or backward inside the body 200 so as to put the dummy bullets into the cartridge chamber and to fire the same. The bolt assembly 300 moves forward or backward together with the bolt 350 that will be described hereunder such that recoil and a following thrill can be experienced. The bolt assembly 300 includes a piston 320, a bolt spur gear 310, and a bolt 350.

A piston 320 is provided and installed inside the bot assembly 300 such that elastic force acts in a direction where the dummy bullet is shot. The piston 320 includes a piston spring 330 and a spring support part 340.

The piston spring 330 is installed inside the piston 320 and is compressed by the bolt assembly 300. When the trigger 410 that will be described hereunder is pulled, the piston spring 330 is stretched so as to move the piston 320 forward and to fire the dummy bullet.

The spring support part 340 is formed on the rear side of the inside of the piston 320 in the shape of a rod. The piston spring 330 is inserted from the front of the spring support part 340 and fixed on the rear side of the spring support part 340. The spring support part 340 guides the piston spring 330 so as to prevent the piston spring 330 from being twisted and entangled, thereby preventing damage to the piston spring 330 when the piston spring 330 is stretched and compressed, and transfers enough pressure when the dummy bullet is shot.

A bolt spur gear 310 is provided at the lower portion of the bolt assembly 300. The bolt spur gear 310 is selectively coupled with a piston gear 610 of the gear part 500 that will be described hereunder so as to move.

The bolt 350 is provided at the bolt assembly 300. The bolt 350 is a portion in which the piston 320 is excluded from the bolt assembly 300 and into which the piston 320 is inserted. The bolt 350 moves backward together with the piston 320, and when the bolt 350 moves forward, the piston 320 is caught and fixed by the shear 540 that will be described hereunder such that the bolt 350 move forward alone.

Next, a driving portion 400 is provided at the lower portion of the bolt assembly 300.

Specifically, the driving portion 400 drives the bolt assembly 300 such that the dummy bullet is put into the cartridge chamber and is shot. The driving portion 400 includes a gear part 500, a trigger 410, a driving power switch 420, a power-on part 430, a power-off part 440, a gear rotation prevention device 450, and an adjustment lever 460.

A plurality of gear parts 500 are provided inside the driving part 400, are connected with a driving motor 240 inside the handle 230, and receives power so as to put the dummy bullet into the toy gun and fire the same. The gear part 500 includes a first gear 510, a second gear 520, a third gear 600, and a gear disengagement device 530.

The first gear 510 is connected with the driving motor 240 so as to receive power.

The second gear 520 connects the first gear 510 and the third gear 600 that will be described hereunder, and receives power from the first gear 510.

Figure 4:
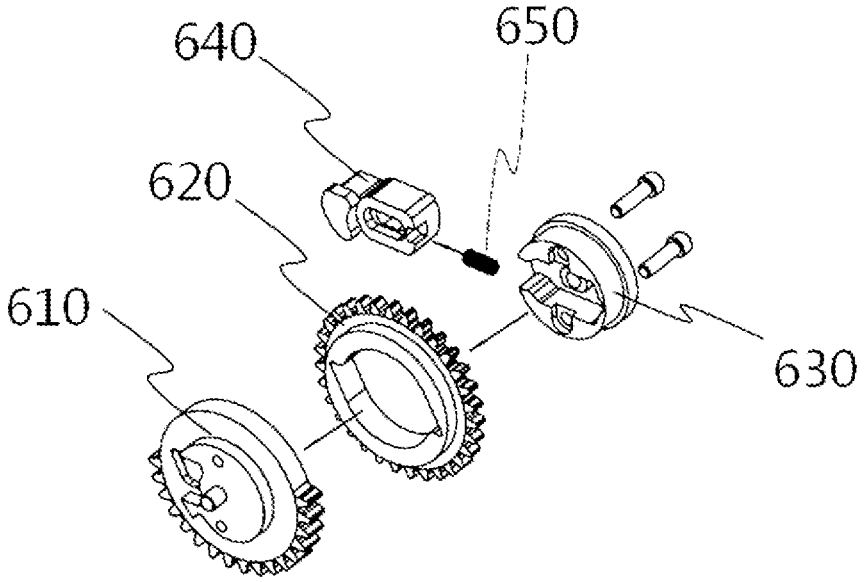
FIG. 4 is a view illustrating a third gear of a toy gun according to the present invention.
Figure 5:
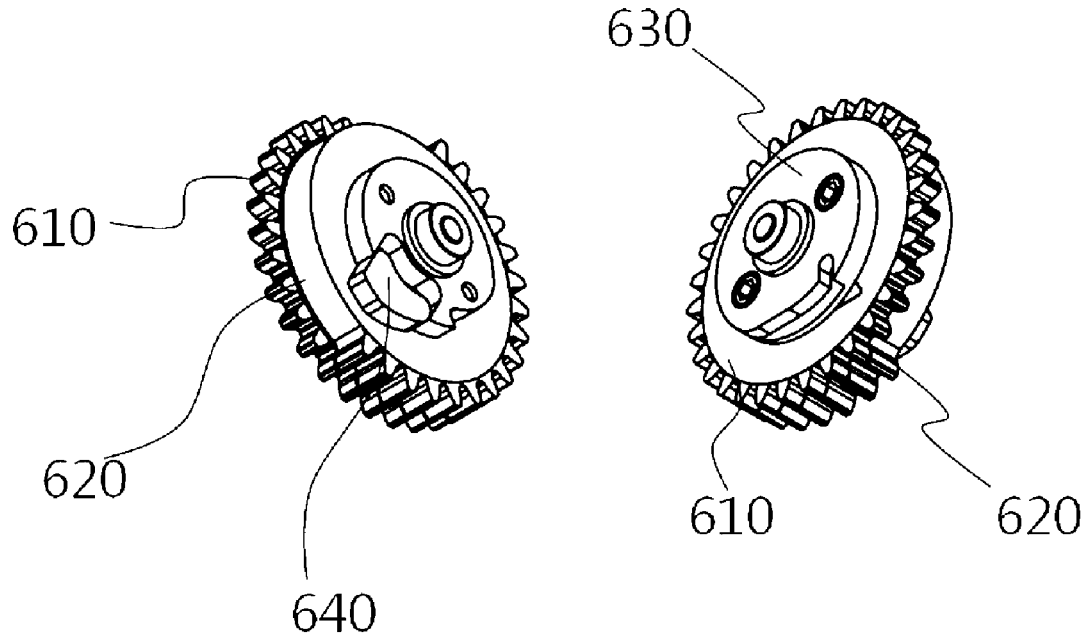
FIG. 5 is a block diagram illustrating a third gear of a toy gun according to the present invention.
Figure 6:
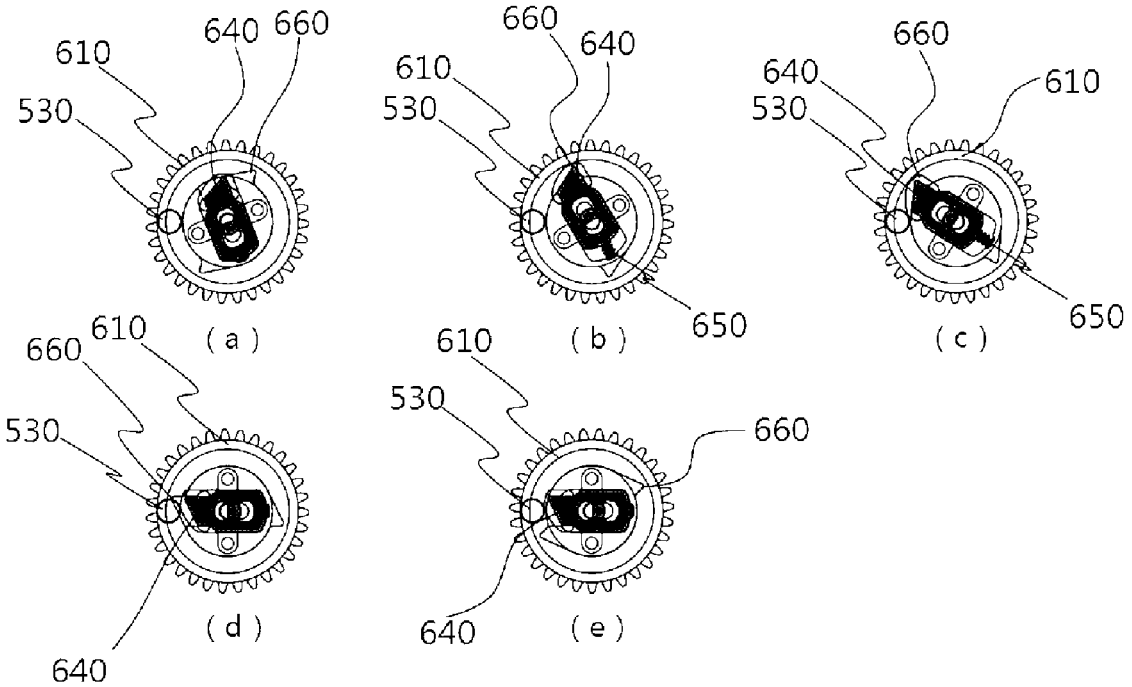
FIG. 6 is a view illustrating how a piston gear and a ratchet gear are coupled and separated by a ratchet pole of a toy gun according to the present invention.
Figure 7:
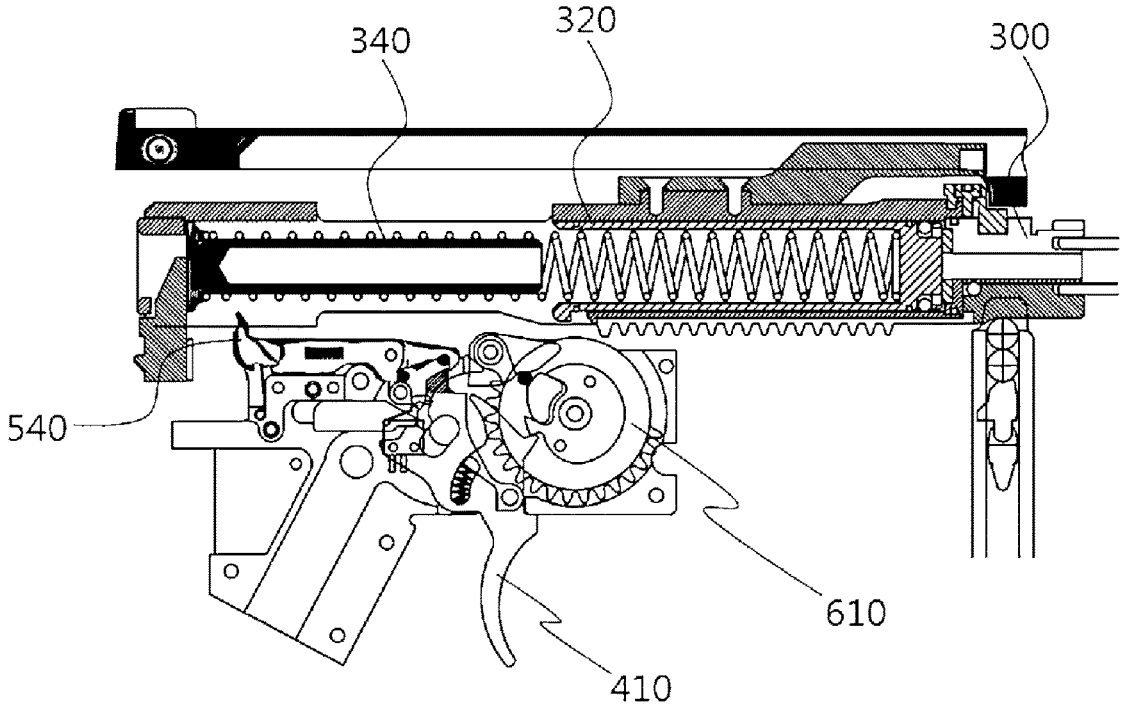
FIG. 7 is a view illustrating first stage fire of a toy gun according to the present invention in single and continuous shot states.
Figure 8:
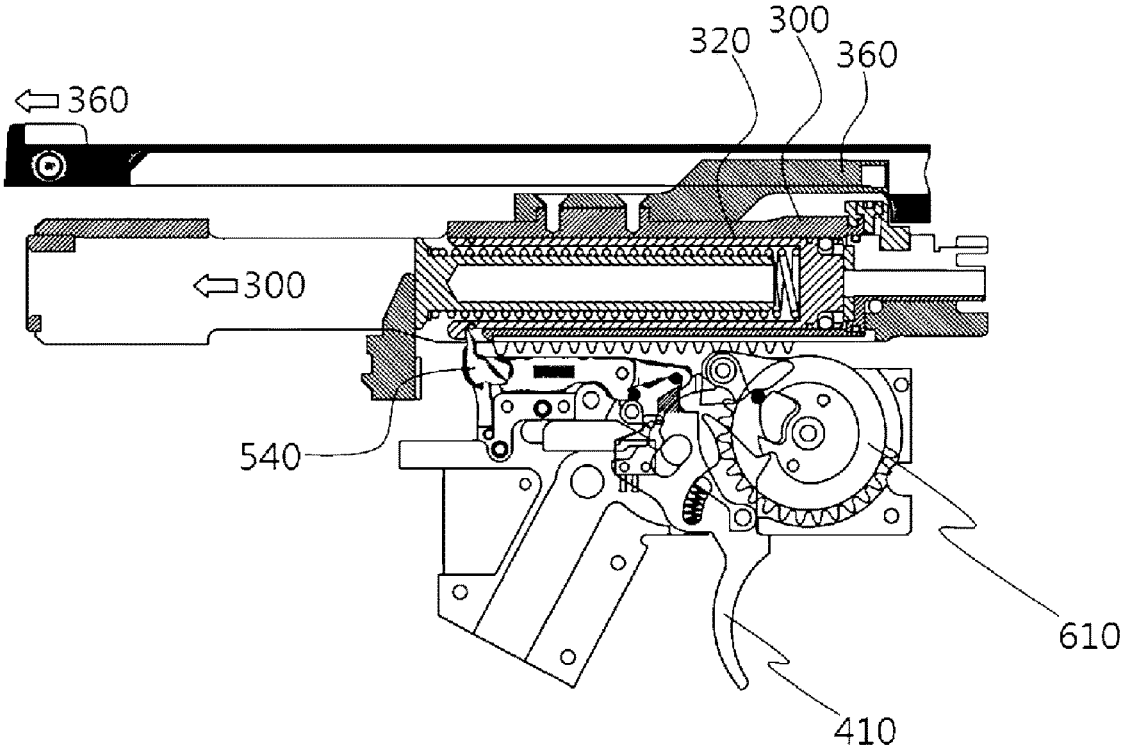
FIG. 8 is a view illustrating second stage fire of a toy gun according to the present invention in single and continuous shot states.
Figure 9:
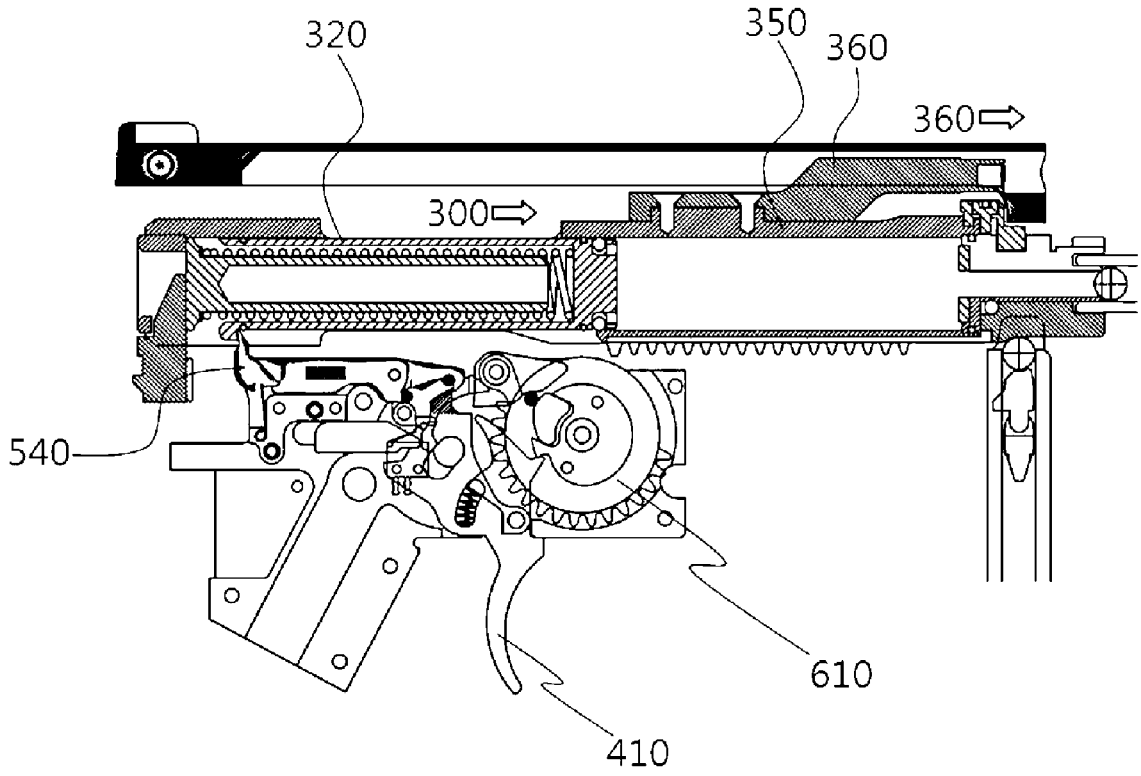
FIG. 9 is a view illustrating third stage fire of a toy gun according to the present invention in single and continuous shot states.
Figure 10:
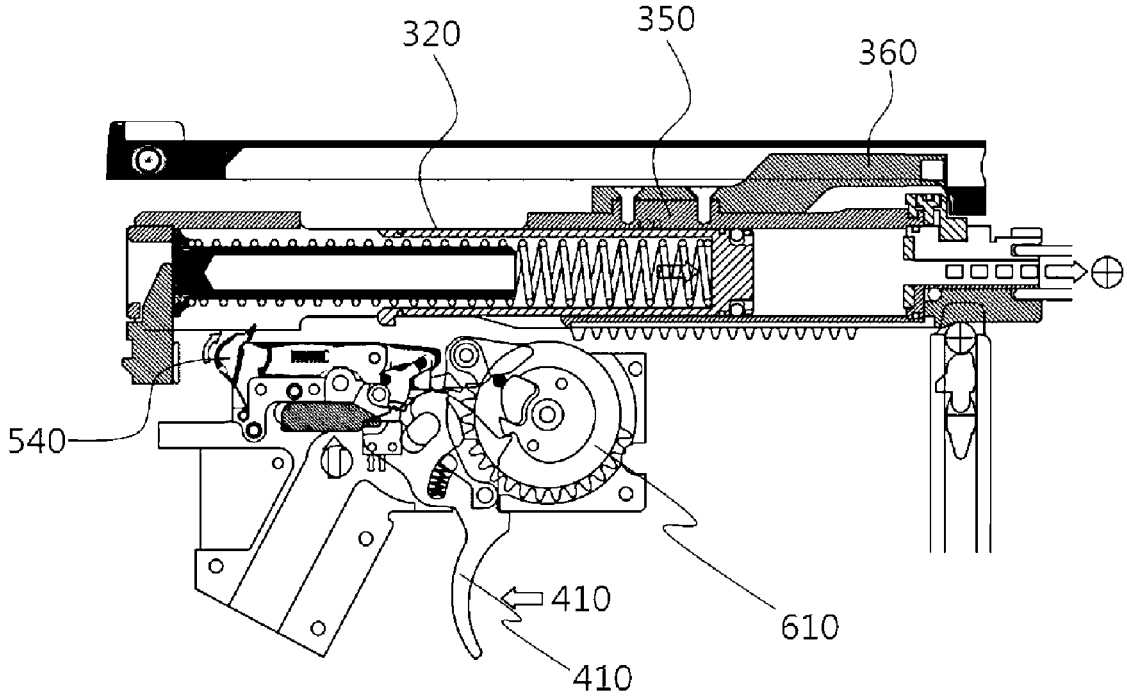
FIG. 10 is a view illustrating fourth stage fire of a toy gun according to the present invention in single and continuous shot states.
Figure 11:
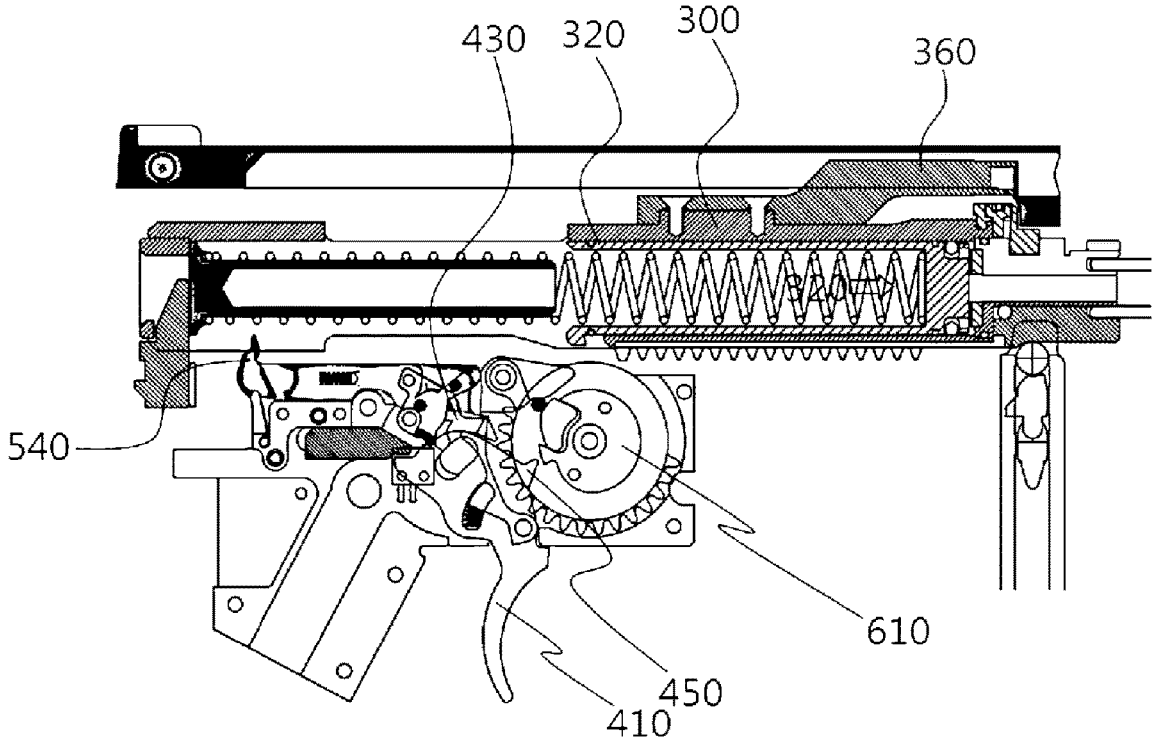
FIG. 11 is a view illustrating fifth stage fire of a toy gun according to the present invention in a single shot state.
Figure 12:
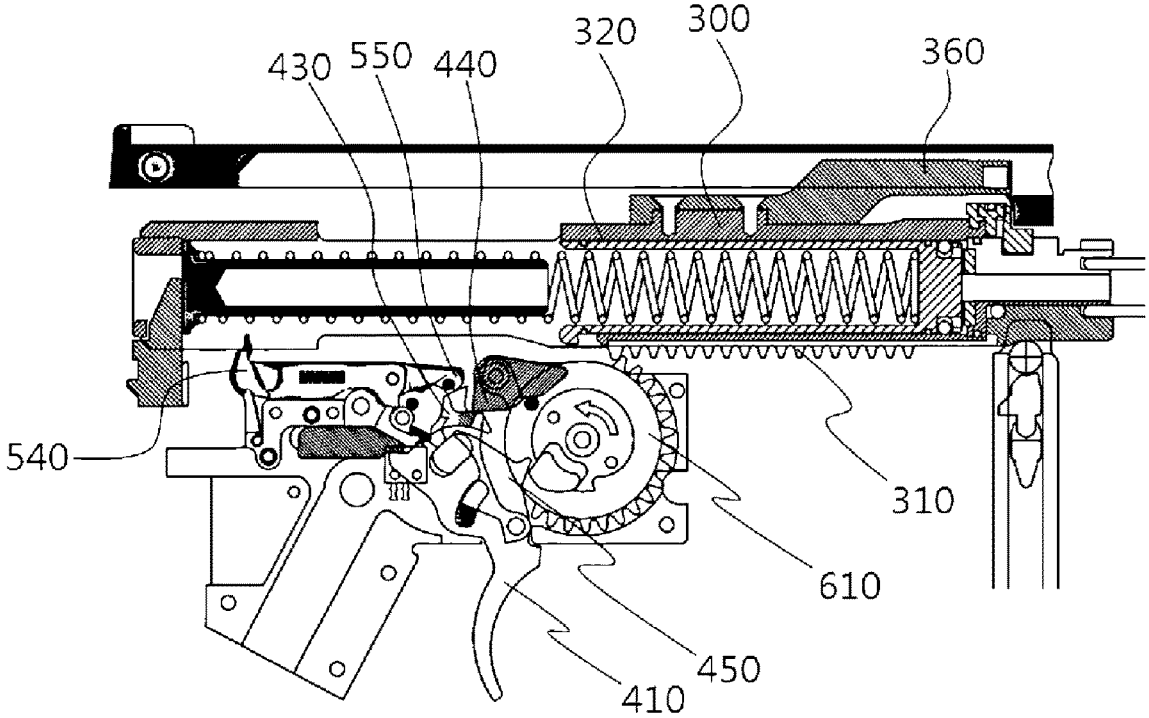
FIG. 12 is a view illustrating sixth stage fire of a toy gun according to the present invention in a single shot state.
Figure 13:
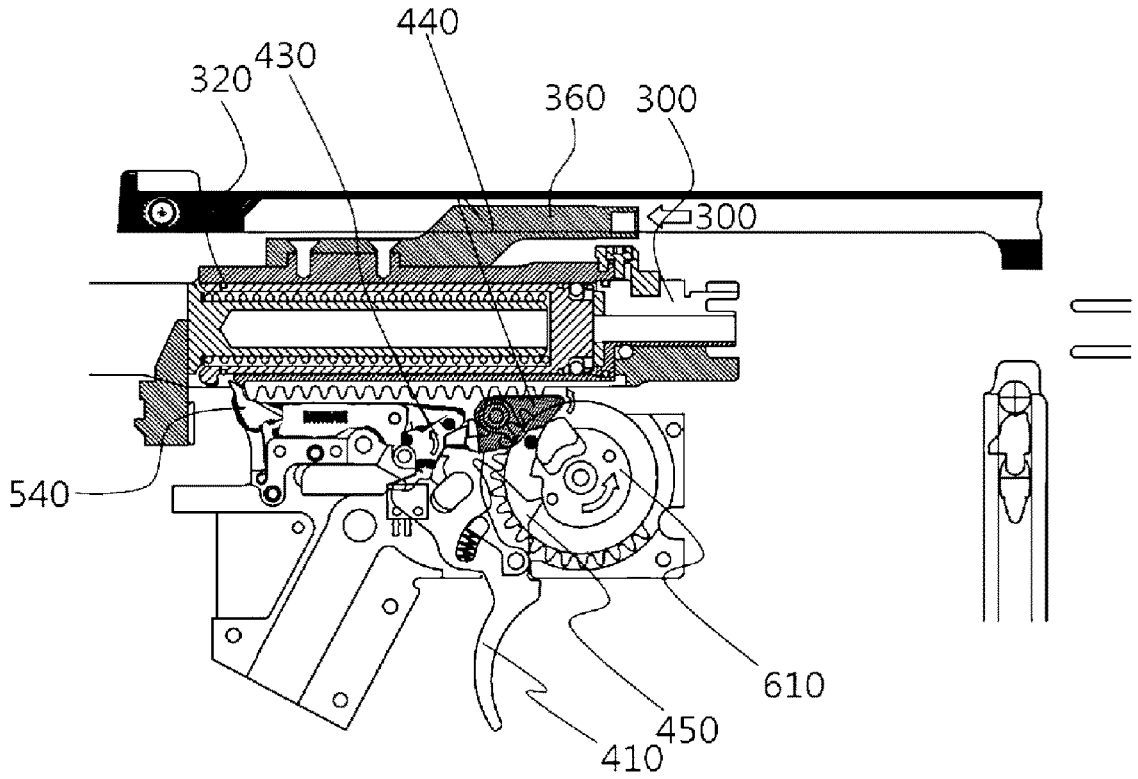
FIG. 13 is a view illustrating seventh stage fire of a toy gun according to the present invention in a single shot state.
Figure 14:
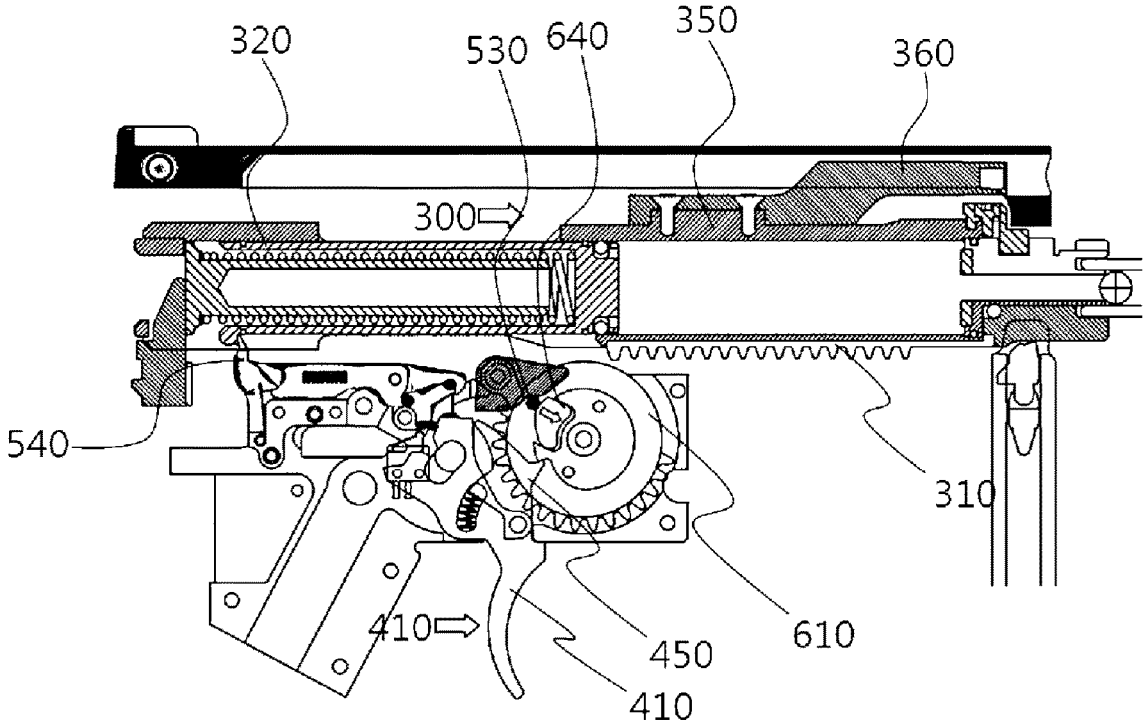
FIG. 14 is a view illustrating eighth stage fire of a toy gun according to the present invention in a single shot state.
Figure 15:
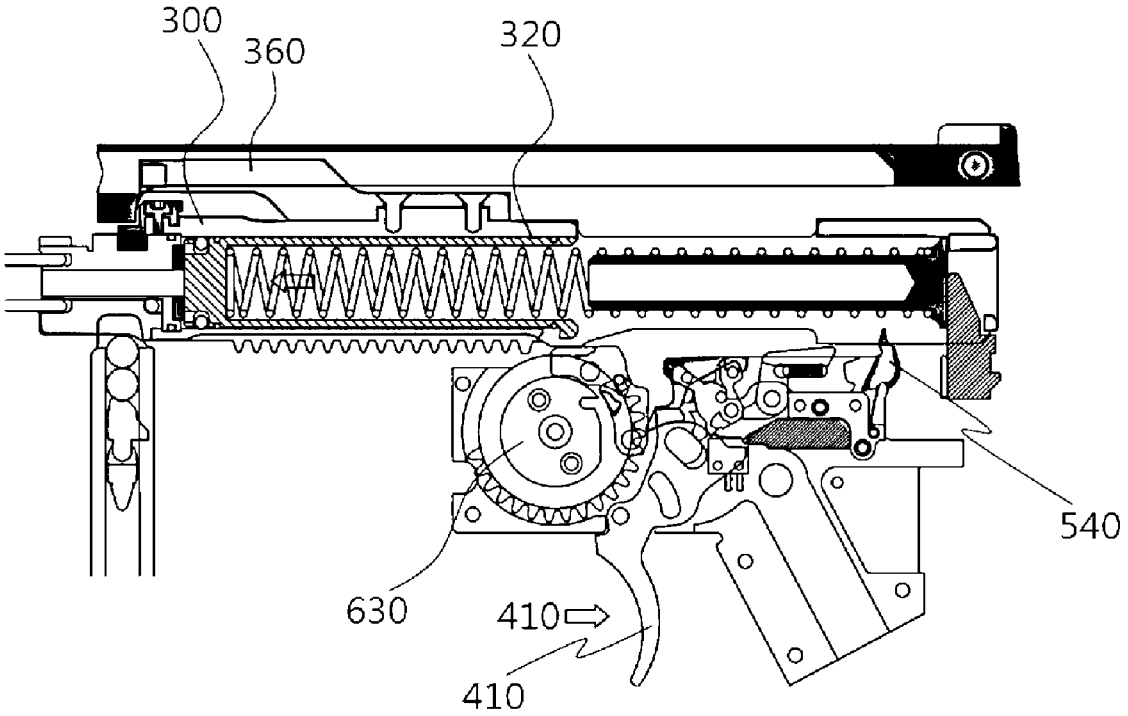
FIG. 15 is a view illustrating fifth stage fire of a toy gun according to the present invention in a continuous shot state.
Figure 16:
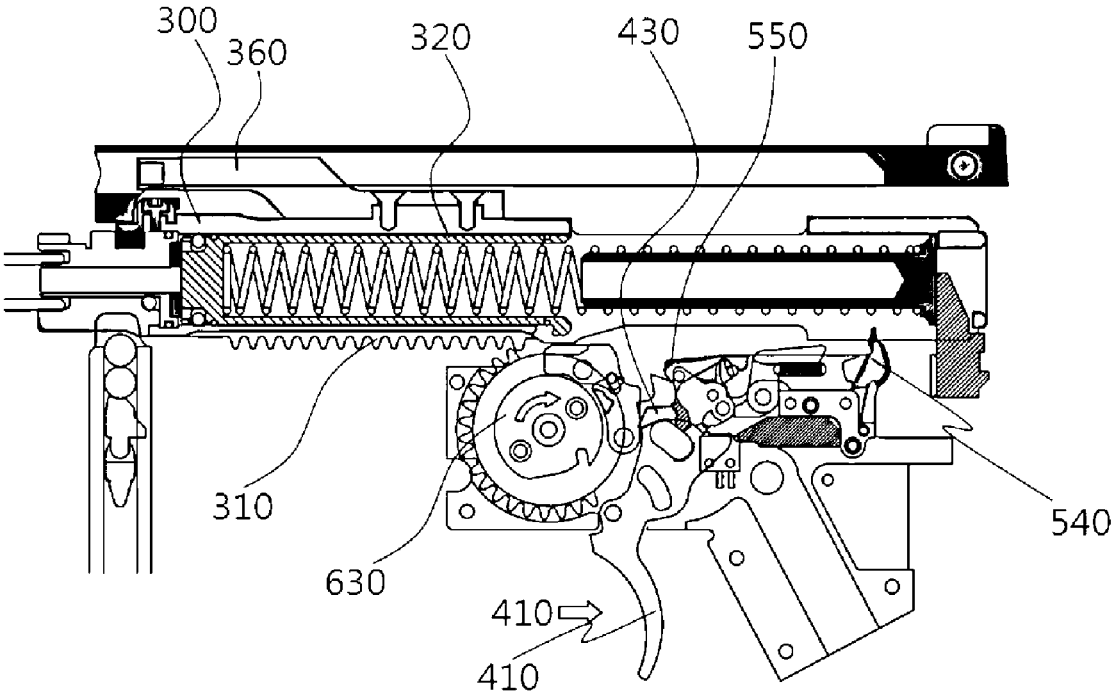
FIG. 16 is a view illustrating sixth stage fire of a toy gun according to the present invention in a continuous shot state.
Figure 17:
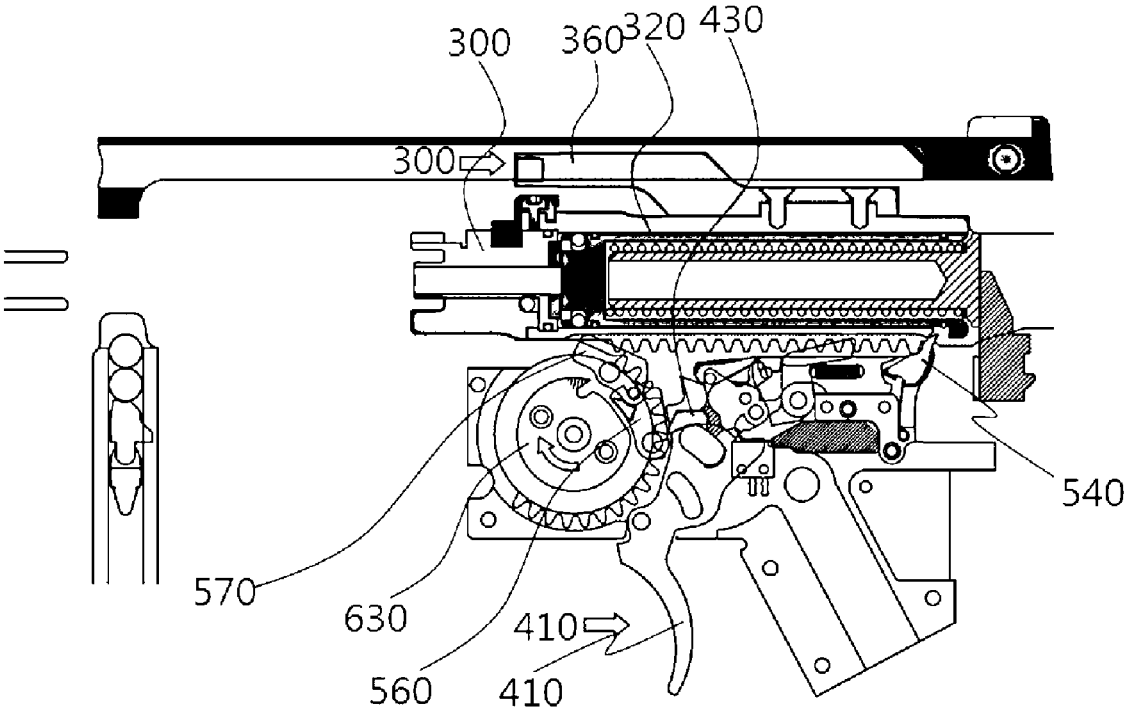
FIG. 17 is a view illustrating seventh stage fire of a toy gun according to the present invention in a continuous shot state.
Figure 18:
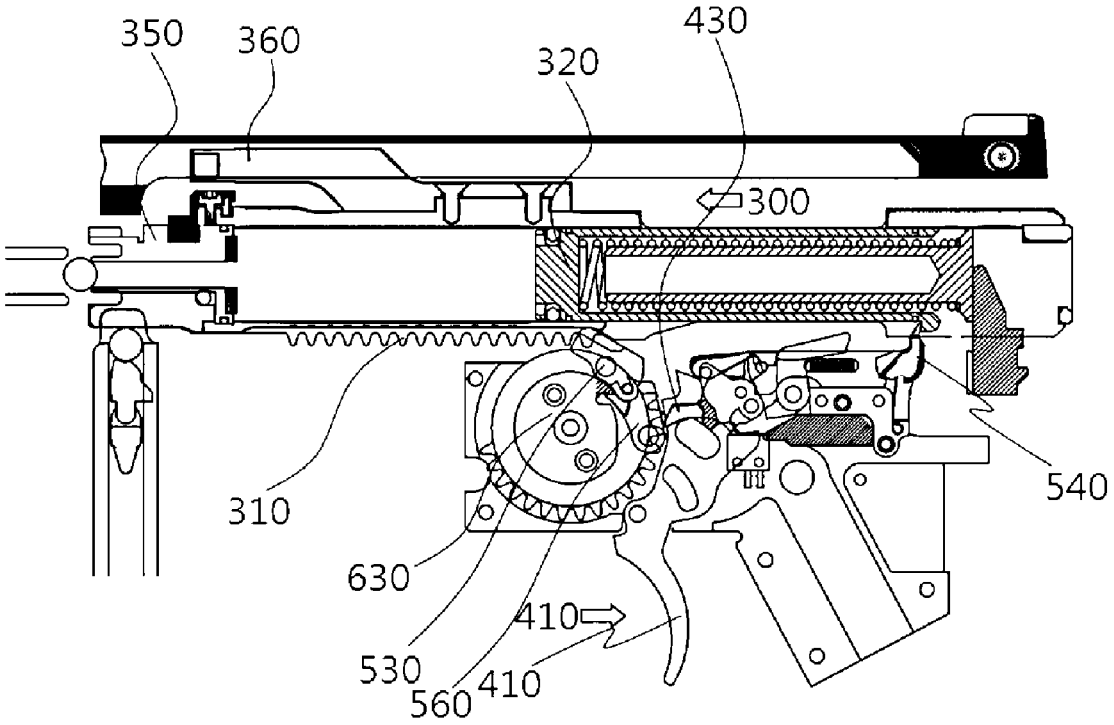
FIG. 18 is a view illustrating eighth stage fire of a toy gun according to the present invention in a continuous shot state.
Figure 19:
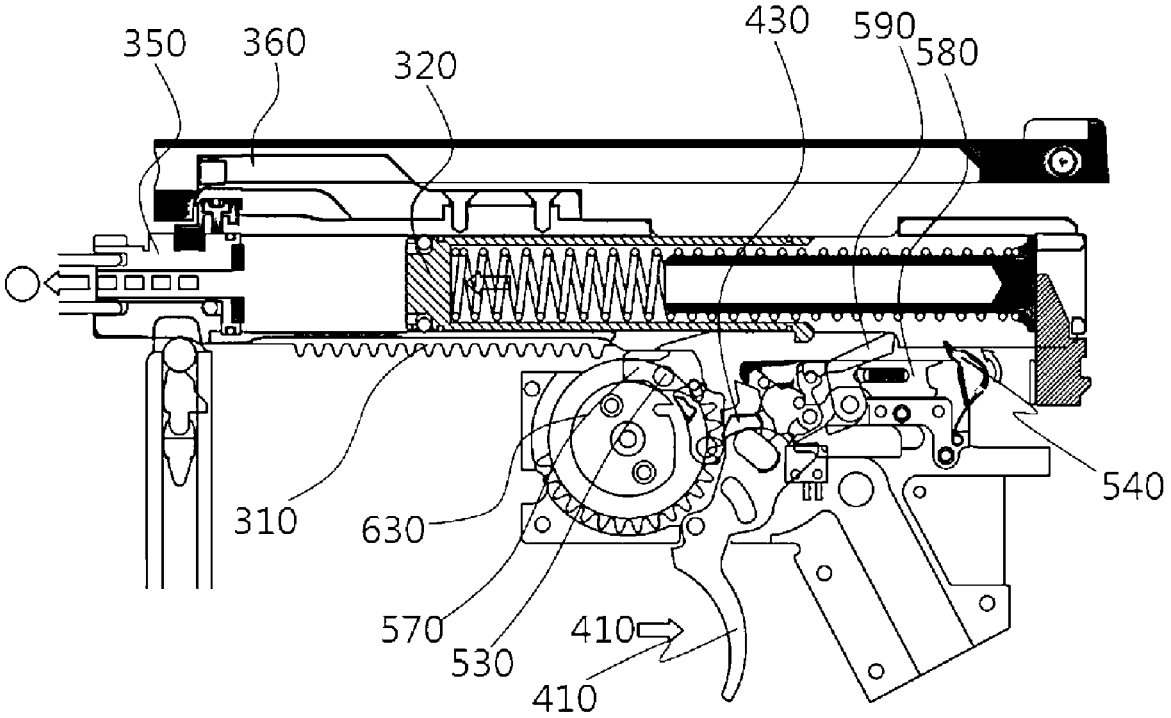
FIG. 19 is a view illustrating ninth stage fire of a toy gun according to the present invention in a continuous shot state.
Figure 20:
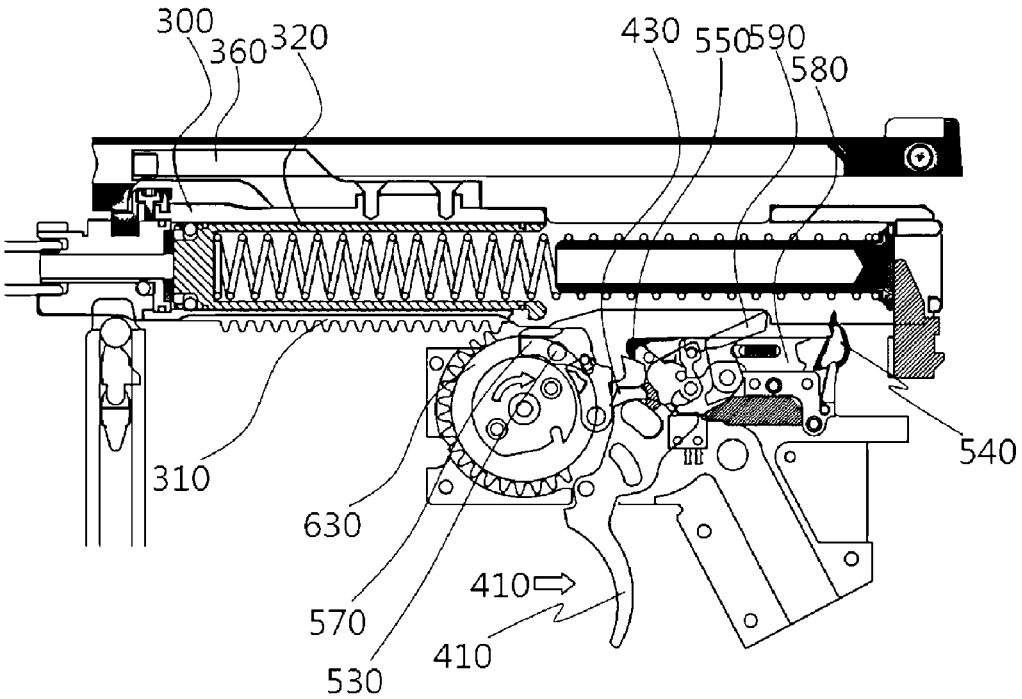
FIG. 20 is a view illustrating tenth stage fire of a toy gun according to the present invention in a continuous shot state.
Figure 21:
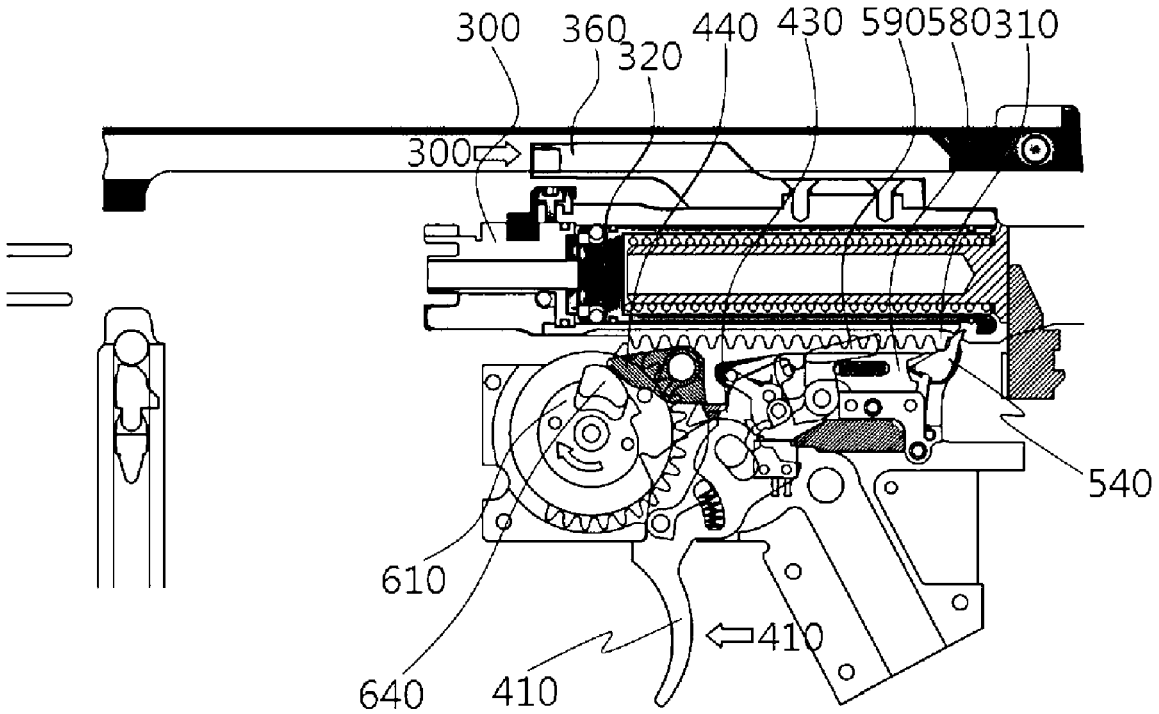
FIG. 21 is a view illustrating eleventh stage fire of a toy gun according to the present invention in a continuous shot state.
Figure 22:
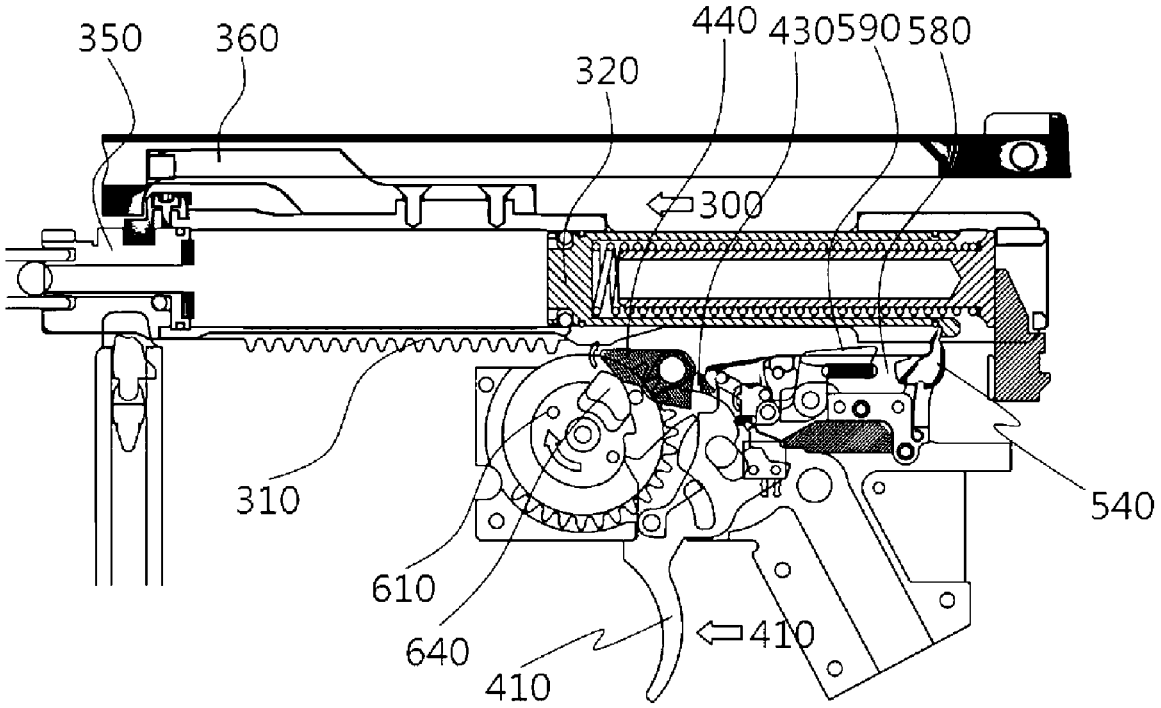
FIG. 22 is a view illustrating twelfth stage fire of a toy gun according to the present invention in a continuous shot state.
Figure 23:
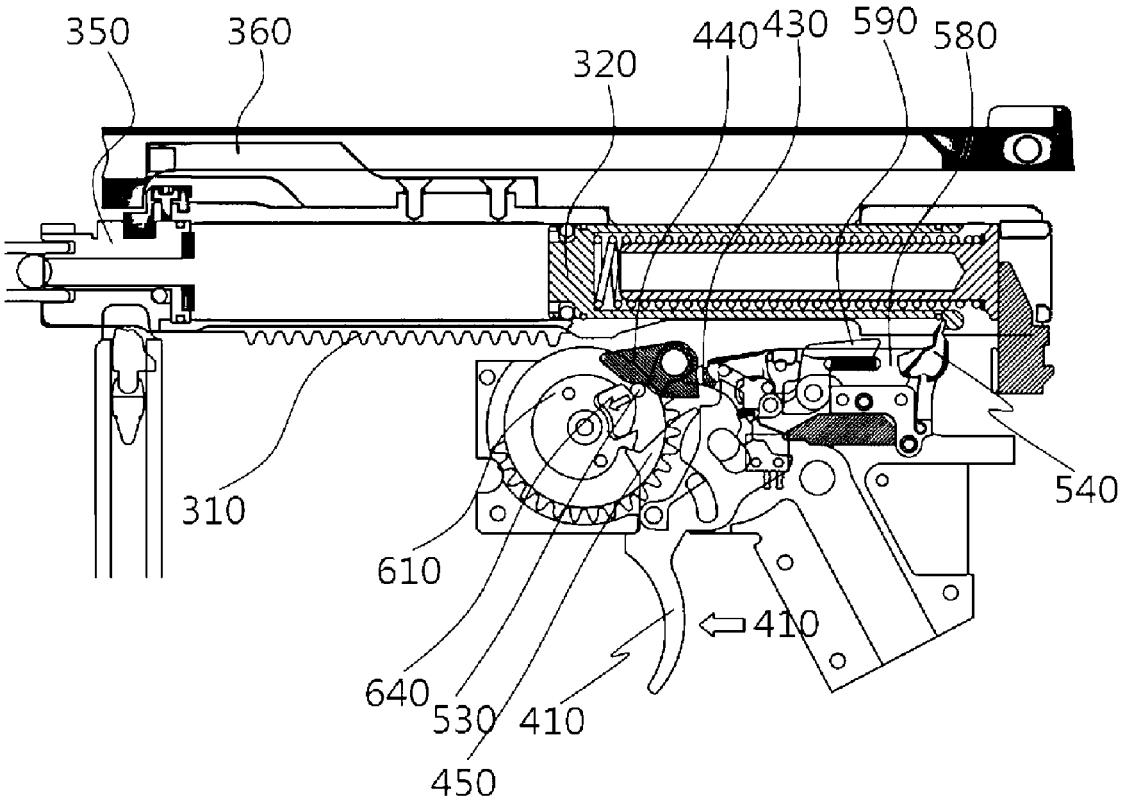
FIG. 23 is a view illustrating thirteenth stage fire of a toy gun according to the present invention in a continuous shot state.

The third gear 600 is connected with the second gear 520 so as to receive power. The third gear 600, as illustrated in FIGS. 4 and 6, includes a piston gear 610, a ratchet gear 620, a ratchet assembly 670.

A gear is formed only at half the outer circumferential surface of the piston gear 610, and a protrusion part is formed on one side of the piston gear 610.

The piston gear 610 is selectively coupled with the bolt spur gear 310 at the lower end of the bolt assembly 300. The piston gear 610 is coupled with the bolt spur gear 310 so as to move the bolt assembly backward.

A space for accommodation is formed inside the ratchet gear 620, and an engaging groove 660 is provided in the space. A gear is formed at the outer circumferential surface of the ratchet gear 620 and positioned on one side of the piston gear 610.

A piston gear cap 630 penetrates the ratchet gear 620, is coupled with the piston gear 610, and couples the ratchet gear 620 and the piston gear 610.

A ratchet assembly 670 selectively transfers, to the piston gear, power transferred to the ratchet gear. The ratchet assembly 670 includes a piston gear cap 630, a ratchet pole 640, a ratchet pole spring 650.

The ratchet pole 640 is coupled to a space at the piston gear cap 630. The ratchet pole 640 selectively couples the piston gear 610 to the ratchet gear 620, and releases the piston gear 610 from the ratchet gear 620.

A ratchet pole spring 650 is installed in the space to which the ratchet pole 640 is coupled and which is provided at the piston gear cap 630, and is positioned further inward than the ratchet pole 640 so as to push the ratchet pole 640 outward.

When the piston gear cap 630 rotates, if the ratchet pole 640 is caught by the engaging groove 660 of the ratchet gear 620, the ratchet gear 620 and the piston gear 610 are coupled so as to rotate together, and if the ratchet pole 640 is released from the engaging groove 660 by means of the gear disengagement device 530 that is provided on one side of the third gear 600 and that will be described hereunder, the ratchet gear 620 and the piston gear 610 are uncoupled such that the ratchet gear 620 only rotates.

FIG. 6 illustrates how the piston gear 610 and ratchet gear 620 are coupled and separated. FIG. 6*a* illustrates a state where the piston gear 610 and ratchet gear 620 are not coupled. FIG. 6*b* illustrates a state where the ratchet gear 620 and the piston gear 610 are coupled by means of the coupling of the ratchet pole 640, pushed outward by means of the ratchet pole spring 650, and the engaging groove 660 of the ratchet gear 620. FIG. 6*c* illustrates a state where the ratchet pole 640 is caught by the gear disengagement device 530. FIG. 6*d* illustrates a state where the ratchet pole 640 is caught by the gear disengagement device 530, and released from the engaging groove 660, and the ratchet gear 620 and the piston gear 610 are separated. FIG. 6*e* illustrates a state where the ratchet gear 620 and the piston gear 610 are separately driven.

The gear disengagement device 530 is installed on one side of the third gear 600. The gear disengagement device 530 releases the ratchet pole 640, coupled to the engaging groove 660 and rotating, from the engaging groove 660. When the ratchet pole 640 is released from the engaging groove 660, the ratchet gear 620 and the piston gear 610 are separated.

A shear 540 is configured to protrude upwards from the upper portion of the rear of the driving portion 400 so as to rotate. The shear 540 hangs the piston 320 inside the bolt assembly 300 in the state where the piston 320 is moved backward when the bolt assembly 300 moves forwards after a backward movement. Additionally, the shear 540 release the piston 320, caught in the state of being moved backward, such that the piston 320 moves forward when the trigger 410 operates.

The trigger 410 is positioned at the front of the handle 230, and swivels by means of a user's manipulation so as to fire the dummy bullet.

A driving power switch 420 is provided on one side of the driving portion 400. The driving power switch 420 is linked with the gear part 500 so as to supply and block power.

A power-on part 430 is linked with the third gear 600 so as to supply power to the driving power switch 420 at the time of single, continuous shot operations.

A power-off switch 440 is linked with the third gear so as to block power of the driving power switch 420 at the time of single, continuous shot operations.

A gear rotation prevention device 450 is installed on one side of the trigger 410. The gear rotation prevention device 450 is caught by or released from a protrusion part of the piston gear 610. That is, when the gear rotation prevention device 450 is caught by the protrusion part of the piston gear 610, the gear rotation prevention device 450 fixes the piston gear 610 so as to prevent the piston gear from rotating, and when the gear rotation prevention device 450 is released from the protrusion part of the piston gear 610, the gear rotation prevention device 450 rotates the piston gear 610. When the trigger 410 is pulled, the gear rotation prevention device 450 swivels the power-on part 430 such that the driving power switch 420 is turned on.

An adjustment lever 460 is installed on one side of the driving portion 400, and connects with the gear part 500 so as to set a state in which the dummy bullet is fired through a user's manipulation. The adjustment lever 460 can set a safe state, a single shot state, a continuous shot state of the dummy bullet.

Operations of a toy gun 100 according to the present invention with the above-described configurations will be described in detail on the basis of each step.

First, a shot is ready In this step, no operation is performed (step 1).

Next, a charging handle 360 is pulled. When the charging handle 360 is pulled, a bolt assembly 300 inside the charging handle 360 moves backward, and a piston 320 is caught by a shear 540. Accordingly, a piston spring 330 is compressed (step 2).

Next, the charging handle 360 is moved forward. When the charging handle 360 moves forward, the bolt assembly 300 inside the charging handle 360 moves forward, and the piston 320 is caught by the shear 54 and fixed in the state where the piston 320 is moved backward. In this case, a piston spring 330 is compressed, and air is introduced into a bolt 350, and then one dummy bullet is put into a cartridge chamber (step 3).

Next, a trigger 410 is pulled. When the trigger 410 is pulled, the piston 320 escapes from the shear 540, moves forward, and fires the dummy bullet put into the cartridge chamber (step 4).

The steps 1 to 4 are applied both in single and continuous shots, and applied in the same way until one dummy bullet is fired. FIGS. 7 to 10 illustrate the steps 1 to 4.

First of all, in the case of a single shot, steps after step 4 will be described. An adjustment lever 460 is placed at a position for a single shot.

Next, when the trigger 410 is pulled, a gear rotation prevention device 450 on one side of the trigger 410 swivels and escapes from a piston gear 610 so as to swivel a power-on part such that a driving power switch 420 is turned on. When the driving power switch 420 is turned on, a third gear 600 released from the gear rotation prevention device 450 starts to rotate (step 5 in a single shot state).

Next, the third gear 600 is coupled to a bolt spur gear 310 while rotating, and prepares for a backward movement of a bolt assembly 300. In this case, the power-on part 430 is caught by a power-off part 440, and a shear hook 550 is released from the trigger 410 (step 6 in the case of a single shot).

Next, the third gear 600 moves the bolt assembly 300 backward, and escape from the bolt spur gear 310. In this case, a ratchet gear 620 and a piston gear 610 of the third gear 600 are coupled, and a ratchet pole 640 installed at the third gear 600 pushes and lifts the power-off part 440 such that the driving power switch 420 is turned off (step 7 in a single shot state).

Next, the bolt assembly 300 moved backward moves forward again by a bolt forward moving device at the rear of the bolt assembly 300, and one dummy bullet is put into the cartridge chamber. The ratchet pole 640 of the third gear 600 is released from an engaging groove 660 of the ratchet gear 620 by a gear disengagement device 530, the coupled ratchet gear 620 and piston gear 610 are released, and a first gear 510, a second gear 520 and the third gear 600 are driven by inertial force even when the driving power switch 420 is turned off. In this case, the ratchet gear 620 of the third gear 600 is driven while the piston gear 610 is stopped by the gear rotation prevention device 450. This is to prevent the bolt 350 from bumping against the piston gear 610 when the bolt 350 moves forward (step 8 in a single shot state). FIGS. 11 to 14 illustrate the steps 5 to 8 in the case of a single shot.

Then the steps 1 to 8 are repeated if the trigger is pulled.

Next, steps after step 4 will be described in the case of continuous shots. The adjustment lever is placed at a position for continuous shots.

Next, when the trigger 410 is pulled, the piston 320 moves forward. The gear rotation prevention device 450 swivels so as to escape from a protrusion part of the piston gear 610, and swivels the power-on part 430 so as to turn on the driving power switch 420. Additionally, a gear coupling device 560 and a protrusion part of a piston gear cap 630 are released, and the third gear 600 starts to rotate (step 5 in a continuous shot state).

Next, when the trigger 410 is pulled, the upper portion of the trigger 410 and the end of the power-on part 430 are caught. When the trigger 410 is pulled in a continuous shot state, the driving power switch 420 is kept on. In this case, the ratchet gear 620 and the piston gear 610 of the third gear 600 are coupled. The shear hook 550 escapes from the trigger 410, the third gear 600 rotates and is coupled with the bolt spur gear 310, and a backward movement of the bolt assembly 300 is prepared (step 6 in a continuous shot state).

Next, the third gear 600 moves the bolt assembly 300 backward and escapes from the bolt spur gear 310. A gear coupling operation device 570 is lifted at and linked with a linear groove formed on one side of the lower end of the bolt 350 such that the gear coupling device 560 is positioned right before being caught by the protrusion of the piston gear cap 630. The ratchet gear 620 and the piston gear 610 of the third gear 600 are coupled (step 7 in a continuous shot state).

Next, the piston 320 is caught by the shear 540, the bolt is moving forward, and one dummy bullet is put into the cartridge chamber. The trigger 410 is pulled, and the upper portion of the trigger 410 and the power-on part 430 are caught. When the trigger 410 is pulled in a continuous shot state, the driving power switch 420 is kept on. The ratchet pole 640 of the third gear 600 is released from the engaging groove 660 by the gear disengagement device 530 such that the ratchet gear 620 and the piston gear 610 are separated. The gear coupling device 560 is caught by the protrusion of the piston gear cap 630. The ratchet gear 620 is driven while the piston gear 610 is not driven but fixed. The bolt 350 is prevented from bumping into the piston gear 610 because the piston gear does not rotate but is fixed while the bolt 350 is moving forward again (step 8 in a continuous state). FIGS. 15 to 18 illustrate the steps 5 to 8 in a continuous shot state.

Next, as the bolt 350 moves forward, the lower protrusion of the bolt 350 presses the gear coupling operation device 570, and the linked gear disengagement device 530 is separated from the protrusion of the piston gear 610.

As the bolt 350 moves forward, a continuous shot shear operation device 590 is caught by a protrusion part formed at the lower portion of the rear end of the bolt 350, rotates, and moves a shear operation device 580, coupled to the shear 540 and operating the shear 540, forward. Then the shear operation device 580 and the shear 540 are separated, the piston 320 escapes from the shear 540 and moves forward (step 9 in a continuous shot state).

Next, the trigger 410 escapes from the shear hook 550, and the third gear 600 rotates, is coupled with the bolt spur gear 310, and prepares for a backward movement of the bolt assembly 300 (step 10 in a continuous shot state).

Next, when the trigger 410 is released, the third gear 600 rotates, move the bolt assembly 300 backward, and is positioned right before the third gear escapes from the bolt spur gear 310. Even when the trigger 410 is released, the power-on part 430 and the power-off part 440 are coupled such that the driving power switch 420 is turned on (step 11 in a continuous shot state).

Next, the third gear 600 rotates, the bolt 350 moves forwards, the piston 320 is caught by the shear 540, and one dummy bullet is put into the cartridge chamber. The ratchet pole 640 pushes and lifts the power-off part 440 while rotating, the power-on part 430 and the power-off part 440 are separated, the power-on part 430 returns to a place where the power-on part was, and the driving power switch 420 is turned off. The power-on part 430 goes back to a place where the power-on part was, and the continuous shot shear operation device 590 goes back to a place where the continuous shot shear operation device was (step 12 in a continuous shot state).

Next, the ratchet pole 640 of the third gear 600 is released by the gear disengagement device 530 such that the ratchet gear 620 and the piston gear 610 are separated. Additionally, even though the power of a driving motor 240 is turned off, the driving motor 240 partially rotates by means of inertial force, and the linked first 510, second 520 and third 600 gears are driven. The ratchet gear 620 of the third gear 600 is driven, but the piston gear 610 is caught and stopped by the gear rotation prevention device 450. While the bolt 350 is moving forward, the piston gear 610 does not rotate. Accordingly, the bolt 350 and the piston gear 610 are prevented from bumping into each other (step 13 in a continuous shot state). FIGS. 19 to 23 illustrate the steps 9 to 13 in a continuous shot state. Then, when the trigger 410 is pulled, the steps 1 to 13 in a continuous shot state are repeated.

It will be apparent to those skilled in the art to which the present invention pertains that the technical configurations of the present invention may be embodied in different forms without departing from the technical spirit and essential features of the present invention.

Therefore, it should be understood that the above-described embodiments are provided only as examples, and that the present invention is not limited to the embodiments set forth herein. In addition, the scope of the present invention should be defined by the appended claims rather than by the detailed description of the invention, and all the modifications and modified forms drawn from the meaning and scope of the appended claims and the equivalent concepts of the appended claims should be construed as being included in the scope of the present invention.

The invention claimed is:

1. A toy gun comprising:

a body for firing dummy bullets;

a bolt assembly provided inside the body so as to move forward or backward in the process of loading and firing the dummy bullets; and a driving portion provided inside the body so as to drive the bolt assembly in order to load and fire the dummy bullets, the driving portion comprising:

a ratchet gear configured to receive power from a driving motor that drives the driving portion;

a piston gear that receives power from the ratchet gear and moves the bolt assembly backward; and a ratchet assembly configured to selectively transfer, to the piston gear, power transferred to the ratchet gear, the ratchet assembly comprising:

a piston gear cap that penetrates the ratchet gear and is coupled to the piston gear in the state where the ratchet gear is fitted into the center of the piston gear cap; and a ratchet pole configured to slide in one direction with regard to the piston gear cap, wherein an engaging groove, into which the ratchet pole is inserted, is provided on the inner circumferential surface of the piston gear such that power of the driving motor is selectively transferred to the piston gear as the ratchet pole is inserted into and released from the engaging groove.

2. The toy gun according to claim 1 comprising:

a piston provided inside the bolt assembly and configured to push and fire the dummy bullets;

a piston spring provided inside the piston and supplying elastic power to the piston; and a spring support part inserted into the piston spring and guiding the piston spring, wherein the piston spring is compressed while wrapping the spring support part and stretched in a direction where the piston spring moves away from the spring support part.

3. The toy gun according to claim 1 comprising:

a trigger configured to swivel, installed at the driving portion and configured to fire the dummy bullets according to a user's manipulation;

a driving power switch installed at the driving portion and configured to supply power to the driving portion and to block power of the driving portion;

a power-on part linked with the ratchet gear and configured to supply power to the driving power switch;

a power-off part linked with the ratchet gear and configured to block power of the driving power switch; and a gear rotation prevention device installed on one side of the trigger and caught by and released from a protrusion of the piston gear, wherein the gear rotation prevention device swivels the power-on part such that the driving power switch is turned on when the trigger is pulled and then the piston moves forward, the bolt assembly is moved backward by the piston gear when the driving power switch is turned on and then the ratchet gear rotates, and the ratchet pole pushes and lifts the power-off part such that the driving power switch is turned off when the ratchet gear moves the bolt assembly backward.

4. The toy gun according to claim 1 or 3 comprising:

a gear disengagement device provided on one side of the ratchet gear and configured to release the ratchet pole from the engaging groove, wherein the ratchet pole is pressed by the gear disengagement device and released from the engaging groove such that the ratchet gear and the piston gear are separated when the bolt assembly moves backward and then the driving power switch is turned off, the driving motor partially rotates and is linked by means of inertial force such that the ratchet gear is driven even though the driving power switch is turned off, and the piston gear is caught and fixed by the gear rotation prevention device in the state where the piston gear and the ratchet gear are separated such that the piston gear is prevented from bumping into the bolt when the bolt moves forward again.

5. The toy gun according to claim 1 comprising:

an adjustment lever installed on one side of the driving portion, connected with the driving portion, and configured to set a state where the dummy bullets are fired according to the user's manipulation, wherein the upper portion of the trigger and the power-on part are caught such that the driving power switch is kept on when the trigger is pulled if the adjustment lever is in a continuous shot state.

* * * * *